United States Patent [19]

Böhm et al.

[11] Patent Number: 4,674,391

[45] Date of Patent: Jun. 23, 1987

[54] DEVICE FOR SUPPORTING WARHEAD CASE DURING A CHARGE PRESSING STEP

[75] Inventors: Otto Böhm, Jettingen; Georg Lallinger, Schrobenhausen; Hans Föll, Aresing, all of Fed. Rep. of Germany

[73] Assignee: Messerschmitt-Bölkow-Blohm GmbH, Fed. Rep. of Germany

[21] Appl. No.: 761,087

[22] Filed: Jul. 31, 1985

[30] Foreign Application Priority Data

Aug. 2, 1984 [DE] Fed. Rep. of Germany ..... 3428488

[51] Int. Cl.[4] ..... F42B 33/02

[52] U.S. Cl. ..... 86/1.1; 86/20.1

[58] Field of Search ..... 102/476; 86/1.1, 20 R, 86/20 B; 264/1.1

[56] References Cited

U.S. PATENT DOCUMENTS

| | | | |
|---|---|---|---|
| 3,924,510 | 12/1975 | Strunk et al. | 86/1.1 |
| 4,250,792 | 2/1981 | Deigmuller et al. | 86/1.1 |
| 4,455,914 | 6/1984 | Christmann et al. | 102/476 |

*Primary Examiner*—Deborah L. Kyle
*Assistant Examiner*—Ted L. Parr
*Attorney, Agent, or Firm*—McGlew and Tuttle

[57] ABSTRACT

A ring (9) serves to support a case (1) during pressing of a charge (4) of a warhead. On the side, ring (9) is arranged around the case (1), against which a pressing force is exerted. The inside diameter (d) of ring (9) is smaller than the outside diameter (D) of the case at permanent deformation of the case during pressing without ring (9).

5 Claims, 2 Drawing Figures

DEVICE FOR SUPPORTING WARHEAD CASE DURING A CHARGE PRESSING STEP

FIELD AND BACKGROUND OF THE INVENTION

The present invention relates in general to explosive warheads and in particular to a device for supporting the case during the pressing of the charge into a warhead.

For the pressed charges as used today, that is in particular hollow charges, the explosive charge is placed in the form of a precompact structure into the case together with the liner, and finish-pressed. To meet performance requirements, that is, in particular with a view to a high density and absence of fissures of the charge as well as to prevent a gap between charge and liner, during finish pressing a high pressure of generally more than 1000 bars is applied on the charge on the side of the liner.

The finish pressing of the charge is carried out either with or without a support mold, i.e. with a case whose circumference is exposed.

The supporting mold, which essentially surrounds the entire case, is pressed firmly against the case from the outside during the finish-pressing of the charge. It may consist, for example, of several shells, each with a wedge surface on the outside. During finish-pressing the shells with the hollow charge arranged therein are then inserted into an opening which is provided with corresponding wedge surfaces, so that by the joint action of their wedge surfaces with the wedge surfaces of the opening, the shells exert a high supporting pressure on the outside of the case.

Through the supporting mold however, an additional timeconsuming and expensive process step is introduced in the production of a hollow charge. Also the supporting mold is relatively expensive, and changes must be made in the pressing device.

The cases which are used for the finish-pressing of the charge without supporting mold are tested for pressure resistance beforehand, that is, before any parts such as charge etc. are inserted in them.

To this end an apparatus is used by which the cases are pressurized with water at a high pressure. Due to problems of sealing, the maximum attainable pressure is about 800 bars.

However, for the finish-pressing of the hollow charge without supporting mold at a pressing pressure of about 1500 bars and a holding time of 6 seconds, a deflagration with subsequent explosion has occurred, which has led to much damage to machines and buildings.

Various causes have been held responsible for this event. As the case was not smooth, that is, still showed tool marks, it was assumed, for example, that the deflagration was caused by the friction of the explosive along the case. Based on the appearance of case splinters which were found after the explosion, according to another assumption, too high a pressing pressure in the region of the ignition booster was held responsible.

Yet another assumption was that during the finish pressing, cracks developed in the case and that a crystal fracture of the explosive at the sharp edges of the cracks triggered the deflagration.

Several suggestions were made to counter the last-named cause. Thus, it was considered to reduce the finish-pressing pressure. This option, however, was dropped in view of the initiall mentioned performance requirements for pressed charges. Further, several testing methods for the case were proposed, e.g. by means of supersonics of holography techniques. But in view of the large quantities in the industrial production of pressed charges, these testing methods are unsuitable. Also increasing the strength of the case does give the desired result, because thereby its expansion is reduced, and reduced expansion may lead to easier bursting of the case. Also there has been a return to the above described supporting mold. If the fissuration in the case is the cause of said deflagration, this cause is not eliminated by the supporting mold, but is simply shifted into the firing device for the warhead. For then a deflagration does indeed not occur during finish pressing, because defective cases are no longer detected. But due to the high acceleration of the warhead, the case is exposed in the firing device to a pressure which is comparable to that during the pressure test, so that defects which only appear during pressing but do not become effective, will lead to fissuration and hence initiate the deflagration or explosion as the warhead is being fired.

SUMMARY OF THE INVENTION

The object of the invention is to provide a device by which, without increased expenditure for control and without any major changes in the manufacturing process or in the pressing device during the production of pressed charges, in particular hollow charges, a deflagration or explosion of the charge by fissuration in the case is prevented.

Accordingly another object of the invention is to provide a device for supporting the case of a warhead which has an open end for receiving a ram under a selected pressure for pressing a charge into the case, comprising a ring disposed around the open end of the case and having an inner diameter which is smaller than the outer diameter of the case by a permanent deformation of the case under the selected pressure without the presence of the ring.

A further object of the invention is to provide a method of pressing a charge into a case which utilizes a ring around the open end of the case having a selected diameter with respect to the outer diameter of the case.

Fissuration and hence sharp edges in the case, which may lead to deflagration or explosion, occur if the case is expanded so much that a permanent deformation results.

For example, with an extruded steel case having an outside diameter of 110 mm when pressurized with water at a pressure of 500 bars, an expansion (without permanent deformation) of the outside diameter of 0.21 mm was found. At 820 bars (upon incipient permanent deformation) an expansion of 0.43 mm was found. According to the invention, therefore in this case a ring with an inside diameter of for example 110 mm can be employed.

Such an inside diameter of the ring is thus clearly below the outside diameter of the case at permanent deformation of the case of 0.43 mm when pressing the explosive in without a ring at a pressure of 820 bars, which is comparable to about 1100 bars explosive pressure.

In contrast to the above-mentioned supporting mold, the device of the invention permits an expansion of the case. It is prevented thereby that through the expansion of the case cracks form when the warhead is being fired. For this purpose the ring has an inside diameter which is at least as great as the possible deformation of the outside diameter of the case when the warhead is fired, that is, the inside diameter of the firing tube. This condition is sure to be fulfilled in the mentioned example, where the ring has a diameter of 110.3 mm.

Generally the inside diameter of the ring of the invention is smaller by 10 to 50 percent than the change of the outside diameter of the case at incipient permanent deformation.

Also it was found that the fissuration starts from the side on which the pressing force is applied and also occurs only there. Accordingly, it suffices if during finish-pressing of the charge, the ring of the invention surrounds the case only at this critical point, so that the manufacturing cost of the ring, caused primarily by the precision of the inside diameter, is reduced accordingly.

Generally, therefore, the length of the ring is about 10/100 to 25/100 of the length of the case in the axial direction.

If the warhead is given, at said point, an enlargement at the outer circumference of the case, provided in particular for flow behavior. the axial length fo the ring corresponds, as a maximum, to the length of the enlargement in the axial direction.

By the device according to the invention in particular the following advantages are achieved:

The cost of control need not be increased. That is, a testing apparatus can continue to be used having a maximum pressure of about 800 bars, to detect defective points.

No changes in the manufacturing process and in the manufacturing method in the production of the pressed charge are necessary and hence no additional test blasting or delays in time limits are needed, for example.

The device according to the invention can be employed without having to change the existing pressing devices in any way. The ring according to the invention can be manufactured at relatively low cost.

Should a case take on a permanent deformation for any reason nevertheless and therefore a charge tending to deflagration result, the case will remain stuck in the ring, so that a deflagration can be prevented with certainty and the projectile with the ring can be destroyed. That is, the device according to the invention serves at the same time as proof of permanent deformation and hence of a case which would tend to deflagrate.

A further object of the invention is to provide a device for supporting a warhead case which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
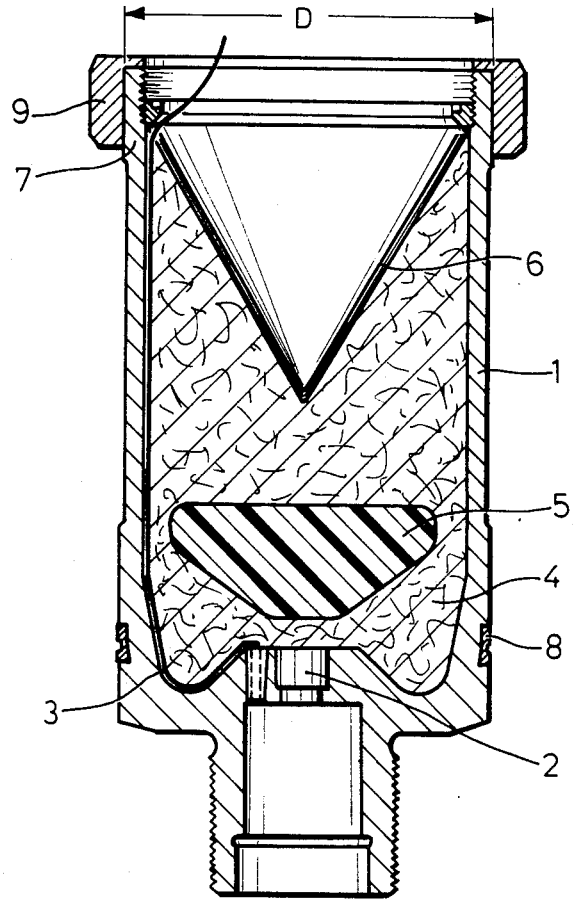
FIG. 1 is a transverse sectional view of a hollow charge of a warhead, around which a ring according to the invention has been placed in finish-pressing.
Figure 2:
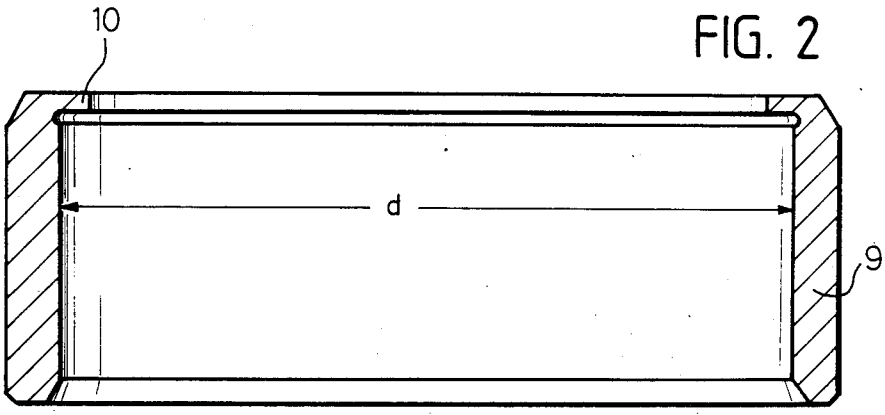
FIG. 2 is an enlarged sectional view of the ring.

According to FIG. 1, a hollow charge has a case 1, in which are inserted a booster 2, a detonator cable 3, a prepressed charge 4 with detonation wave steerage 5, and a barb-forming liner 6.

The finish-pressing of charge 4 is carried out with a press ram (not shown), whose contour is adapted to the contour of the liner 6. At the open front end of case 1, at the outer circumference, an enlargement 7 for improvement of the flow behavior of the warhead is provided. At the rear end of case 1, on the outside, a seal ring 8 is applied.

At the front end, at which the press ram engages, a ring 9 is arranged around case 1. For retention at case 1, ring 9 presents an inwardly extending ring shoulder 10, which rests on the front end face of case 1. Compared with the outside diameter D of case 1 or respectively of the enlargement 7, the inside diameter d of ring 9 is dimensioned so that it is smaller than the outside diameter D of case 1 by a permanent deformation amount which would occur during pressing without ring 9, but greater than the deformation of the outside diameter D of case 1 upon firing of the warhead.

The inside diameter d of ring 9 is perferably smaller by 10–50% than the variation in the outer diameter D of the case 1 occuring at permanent deformation thereof. The ring 9 also preferably has a axial length which corresponds to 10/100 to 25/100 of the length of case 1 in the axial direction.

While a specific embodiment of the invention has been shown and described in detail to illustrate the application of the principles of the invention, it will be understood that the invention may be embodied otherwise without departing from such principles.

What is claimed is:

1. In combination with a warhead case having an open end for receiving a charge and for receiving a predetermined pressure for compressing the charge without an outside mold, the case having a first outer diameter due to a first permanent deformation under the selected pressure and a second outer diameter to a second predetermined deformation upon firing of the case, a ring engaged around the open end of the case having an inside diameter which is smaller than the first diameter and larger than the second diameter so as to support the open end of the case when the open end of the case receives the selected pressure.

2. The combination of claim 1, wherein the inner diameter of the ring is from 10–50% of the variation of the first diameter due to the selected pressure.

3. The combination of claim 2, wherein the ring has an axial length which is from 10–25% the axial length of the case.

4. A device for supporting a warhead case during the pressing of a charge into the case under a selected pressure which would result in the deformation of the case to an increased outside diameter, the case having an open end for receiving the predetermined pressure, comprising a support ring engaged around the open end of the case and having an inner diameter which is less than the deformed outer diameter of the case and which is at least equal to an undeformed outer diameter of the case, the inner diameter of the ring being greater than an outer diameter of the case when the warhead is fired, the inner diameter of the ring being from 10–50% smaller than the outer deformed diameter of the case under the selected pressure, and the ring having an axial length which is from 10–25% of the length of the case in an axial direction.

5. In a method of pressing a charge in a warhead case under a selected pressure which would result in a deformation of the case to an increased outside diameter, the case having an open end for receiving the predetermined pressure, the improvement comprising positioning a support ring around the open end of the case which has an inner diameter which is less than the deformed outer diameter of the case and which is at least equal to an undeformed outer diameter of the case, the inner diameter of the ring being selected to be greater than an outer diameter of the case when the warhead is fired, and pressing the charge without positioning the case in an outside mold.

* * * * *